US010573954B2

(12) United States Patent
Bologna et al.

(10) Patent No.: US 10,573,954 B2
(45) Date of Patent: Feb. 25, 2020

(54) ANTENNA INTEGRATION IN HINGE SHROUD

(71) Applicant: Dell Products L.P., Round Rock, TX (US)

(72) Inventors: Benny J. Bologna, Austin, TX (US); Patrick A. Hampton, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/537,230

(22) Filed: Aug. 9, 2019

(65) Prior Publication Data

US 2019/0363422 A1 Nov. 28, 2019

Related U.S. Application Data

(63) Continuation of application No. 15/192,785, filed on Jun. 24, 2016, now Pat. No. 10,446,908.

(51) Int. Cl.

| | |
|---|---|
| ***H01Q 1/24*** | (2006.01) |
| ***H01Q 1/22*** | (2006.01) |
| ***H01Q 3/04*** | (2006.01) |
| ***H01Q 1/50*** | (2006.01) |

(52) U.S. Cl.

CPC ..... *H01Q 1/2266* (2013.01); *H01Q 1/50* (2013.01); *H01Q 3/04* (2013.01)

(58) Field of Classification Search

CPC ..... H01Q 1/2266; H01Q 1/50; H01Q 3/04; H01Q 1/243

See application file for complete search history.

(56) References Cited

U.S. PATENT DOCUMENTS

| | | | | |
|---|---|---|---|---|
| 2014/0097993 | A1* | 4/2014 | Hotta | H01Q 1/243 343/702 |
| 2015/0102966 | A1* | 4/2015 | Chiu | H01Q 1/2266 343/702 |
| 2015/0244059 | A1* | 8/2015 | Onaka | H01Q 1/44 343/702 |
| 2019/0006736 | A1* | 1/2019 | Hsu | H01Q 1/2266 |

* cited by examiner

*Primary Examiner* — Dieu Hien T Duong
(74) *Attorney, Agent, or Firm* — Baker Botts L.L.P.

(57) ABSTRACT

Systems and methods are disclosed for positioning an antenna in a portable information handling system. A portable information handling system includes a housing having a first housing portion and a second housing portion. The portable information handling system also includes a hinge assembly coupling the first and second housing portions, the hinge assembly comprising at least one gear to rotate the first and second housing portions relative to each other. In addition, the system includes an antenna frame coupled to the gear. The portable information handling system also includes an antenna coupled to the antenna frame, the antenna operable to communicate wirelessly with a wireless-enabled device.

9 Claims, 11 Drawing Sheets

ANTENNA INTEGRATION IN HINGE SHROUD

RELATED APPLICATIONS

This application is a continuation of pending U.S. patent application Ser. No. 15/192,785 filed Jun. 24, 2016, the contents of which is incorporated herein in its entirety by this reference.

TECHNICAL FIELD

This disclosure relates generally to information handling systems and, more particularly, to a system and method for integration of antennas in a hinge shroud of an information handling system.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Examples of information handling systems include portable information handling systems, such as, smart phones, tablet computers, notebook computers, media players, digital cameras, 2-in-1 tablet-laptop combination computers, wireless organizers, and/or combinations thereof. A portable information handling system may generally be any device that a user may carry for handheld use and that includes a processor. These systems may communicate across wireless networks information, such as voice, images, text, video, and data. A portable information handling system may rely on one or more antennas to communicate such information wirelessly. The reception and transmission capabilities of individual antennas may change based on the position of the antenna. Thus, antennas of the portable information handling system may be affected by the physical configuration of the portable information handling system, which may change as a user uses, configures, and/or moves the system. Antenna position may also affect specific absorption rate (SAR) measurements of the systems. Thus, it may be desirable to control the placement of one or more antennas in a portable information handling system.

SUMMARY

In some embodiments, a portable information handling system is disclosed that includes a housing having a first housing portion and a second housing portion. The system also includes a hinge assembly coupling the first and second housing portions, the hinge assembly comprising at least one gear to rotate the first and second housing portions relative to each other. In addition, the system includes an antenna frame coupled to the gear. The system further includes an antenna coupled to the antenna frame, the antenna operable to communicate wirelessly with a wireless-enabled device.

In another embodiment, a method is disclosed that includes rotationally coupling a first housing portion and a second housing portion of the portable information handling system with a hinge assembly, the hinge assembly comprising at least one gear to rotate the first and second housing portions relative to each other. The method also includes coupling an antenna frame to the gear. The method further includes coupling an antenna to the antenna frame, the antenna operable to communicate wirelessly with a wireless-enabled device.

In a further embodiment, a hinge assembly for a portable information handling system is disclosed that includes a first gear and a second gear, the first and second gears rotating a first housing portion relative to a second housing portion of the portable information handling system. The system also includes a first antenna frame coupled to the first gear. The system further includes a second antenna frame coupled to the second gear. In addition, the system includes a first antenna coupled to the first antenna frame, the first antenna operable to communicate wirelessly with a wireless-enabled device. The system also includes a second antenna coupled to the second antenna frame, the second antenna operable to communicate wirelessly with the wireless-enabled device.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

Figure 1:
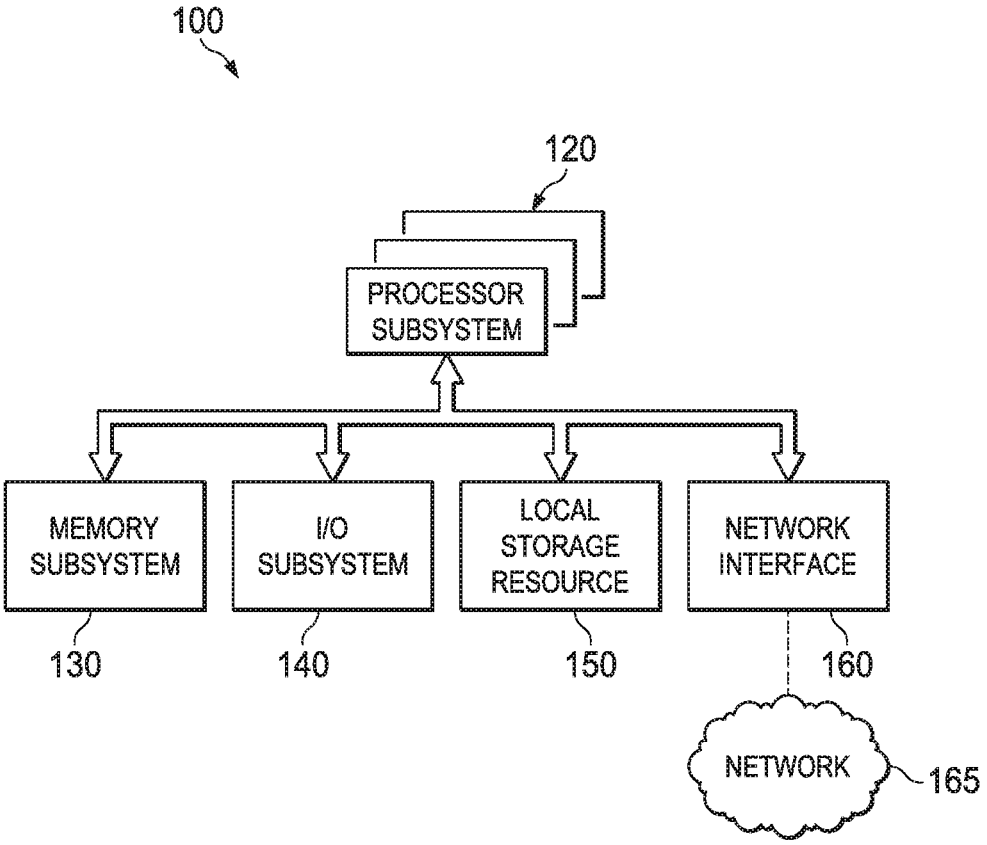
FIG. 1 illustrates a block diagram of selected elements of an embodiment of a portable information handling system.

In the following description, details are set forth by way of example to facilitate discussion of the disclosed subject matter. It should be apparent to a person of ordinary skill in the field, however, that the disclosed embodiments are exemplary and not exhaustive of all possible embodiments.

As used herein, a hyphenated form of a reference numeral refers to a specific instance of an element and the unhyphenated form of the reference numeral refers to the collective or generic element. Thus, for example, widget "72-1" refers to an instance of a widget class, which may be referred to collectively as widgets "72" and any one of which may be referred to generically as a widget "72."

As noted previously, portable information handling systems may utilize wireless communications to transmit and receive information. One or more antennas within the portable information handling systems may be used to transmit and receive information wirelessly. The performance of individual antennas may depend on, among other things, the position and/or surroundings of the antenna. As the portable information handling system is moved and arranged in different physical configurations, the position and/or surroundings of one or more antennas within the system may change thereby affecting the performance of the antennas. The wireless communication performance of the portable information handling system may vary with the performance of individual antennas. In addition, the radiation patterns from the antennas may change based on the position and/or surroundings of the antennas which in turn may affect specific absorption rate (SAR) measurements of the system. Thus, wireless performance may vary as a user uses, configures, and/or moves the system. In addition, SAR exposure requirements as mandated by the FCC may vary between usage modes.

One or more antennas may be placed in the hinge assemble of the portable information handling system to control wireless performance and/or SAR measurements of the system. A portable information handling system may include one or more rotationally-coupled housing portions coupled by a hinge assembly. For example, a lid housing portion of the portable information handling system may be coupled to a main housing portion by a hinge assembly such that the housing portions may be rotated in different positions to each other as a user uses, configures, and/or moves the portable information handling system. An elastic cover may stretch between the housing portions to cover the hinge assembly. The elastic cover may permit radio signals to pass more easily than the materials of the housing portions.

Thus, one or more antennas may be coupled to the hinge assembly. As described in more detail below, the position (e.g., orientation) of the antennas may be controlled relative to the positioning of the housing portions of the portable information handling system. As the housing portions move in different positions to each other, the position of the antenna in the hinge assembly may be controlled to, for example, optimize antenna performance, meet SAR requirements, and/or achieve another purpose.

For the purposes of this disclosure, an information handling system may include an instrumentality or an aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a server, a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

Particular embodiments are best understood by reference to FIGS. 1-9 wherein like numbers are used to indicate like and corresponding parts.

FIG. 1 illustrates a block diagram of selected elements of an embodiment of a portable information handling system 100 in accordance with some embodiments of the present disclosure. In various embodiments, portable information handling system 100 may represent different types of portable information handling systems, such as, smart phones, tablet computers, notebook computers, media players, digital cameras, 2-in-1 tablet-laptop combination computers, and wireless organizers. Components of portable information handling system 100 may include, but are not limited to, processor subsystem 120, which may comprise one or more processors, and system bus 121 that communicatively couples various system components to processor subsystem 120 including, for example, memory subsystem 130, I/O subsystem 140, local storage resource 150, and network interface 160. External or remote elements, such as network 165, are also shown to give context to an environment in which portable information handling system 100 may be configured to operate.

Processor subsystem 120 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 120 may interpret and/or execute program instructions and/or process data stored locally (e.g., in memory subsystem 130). In the same or alternative embodiments, processor subsystem 120 may interpret and/or execute program instructions and/or process data stored remotely (e.g., in a network storage resource, not shown).

System bus 121 may represent a variety of suitable types of bus structures, including for example, a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, PCI bus, PCI-E bus, HyperTransport (HT) bus, Integrated Interchip Sound (IIS) bus, Serial Peripheral Interface (SPI) bus, and Video Electronics Standards Association (VESA) local bus, among others. Although illustrated as a single bus in FIG. 1, system bus 121 may be implemented as a combination of one or more suitable busses, and in some embodiments, various components may use one or more different busses to communicate with other components of portable information handling system 100.

Memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as portable information handling system 100, is powered down.

In portable information handling system 100, I/O subsystem 140 may comprise a system, device, or apparatus generally operable to receive and/or transmit data to/from/within portable information handling system 100. I/O subsystem 140 may represent, for example, a variety of communication interfaces, graphics interfaces, video interfaces, user input interfaces, and/or peripheral interfaces. For example, I/O subsystem 140 may comprise a touch panel and display adapter. The touch panel (not shown) may include circuitry for enabling touch functionality in conjunction with a display (not shown) that is driven by display adapter (not shown).

Local storage resource 150 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. For example, local storage resource 150 may store executable code in the form of program files that may be loaded into memory 130 for execution. In addition to local storage resources 150, in some embodiments, portable information handling system 100 may communicatively couple via network 165 to a network storage resource (not shown) using network interface 160 discussed below.

Network interface 160 may be a suitable system, apparatus, or device operable to serve as an interface between portable information handling system 100 and network 165. Network interface 160 may enable portable information handling system 100 to communicate over network 165 using any suitable transmission protocol and/or standard, including, but not limited to various transmission protocols and/or standards. Network 165 coupled to network interface 160 may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data or information). In some embodiments, network 165 communicatively coupled to network interface 160 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 165, network interface 160, and/or various components associated therewith may be implemented using hardware, software, or any combination thereof. Network interface 160 may enable wired and/or wireless communications to and/or from portable information handling system 100.

To communicate wirelessly, network interface 160 may use one or more antennas (not shown in FIG. 1). Antennas may include any suitable system, apparatus, or device capable of receiving and/or transmitting radio waves, including for example, a monopole antenna, dipole antenna, directional antenna, parabolic antenna, patch antenna, Planar Inverted-F Antenna (PIFA) antenna, slot antenna, microstrip antenna, sector antenna, or another suitable antenna. In some embodiments, portable information handling system 100 may use one or more different types of antennas to communicate with other wireless-enabled devices. Antennas may include any appropriate material, including for example, silver, copper, gold, aluminum, calcium, tungsten, zinc, nickel, iron, mylar, or another material suitable for transmitting and/or receiving radio signals, including a combination of one or more materials. In some embodiments, portable information handling system 100 may use antennas to communicate using one or more wireless communication standards, such as IEEE 802.11n or 802.11ac (Wi-Fi), Evolved High-Speed Packet access (HSPA+, or 3G), Worldwide Interoperability for Microwave Access (WiMAX), and/or Long Term Evolution (4G).

Figure 2:
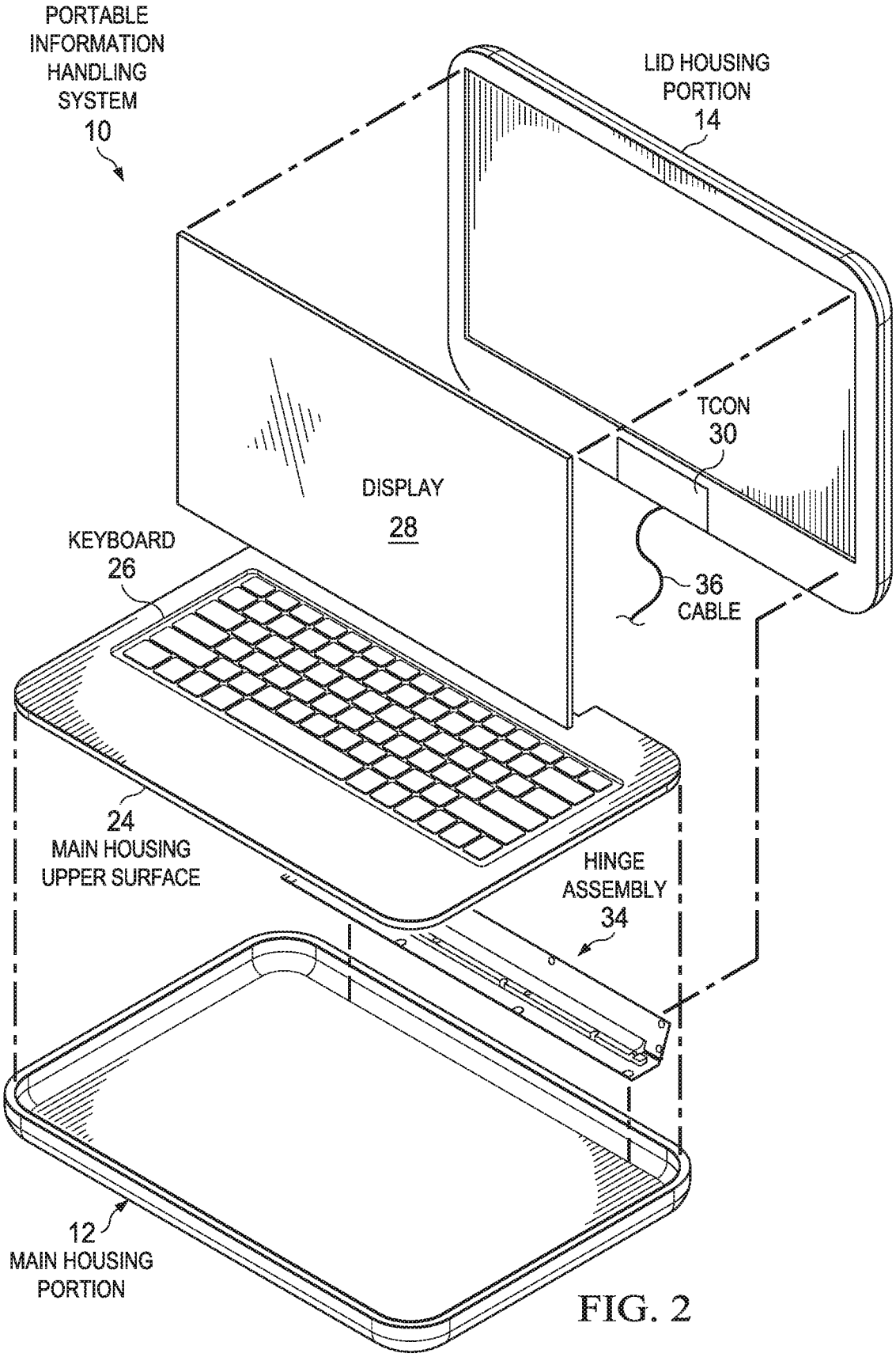
FIG. 2 illustrates a blown-up view of a portable information handling system having rotationally-coupled housing portions.

FIG. 2 depicts a blown-up view of a portable information handling system having rotationally-coupled housing portions. In the example embodiment, a main housing portion 12 rotationally couples to a lid housing portion 14 to support various configurations to interact with an end user. Main housing portion 12 may hold one or more components of the portable information handling system, including but not limited to processor subsystem 120, system bus 121, memory subsystem 130, I/O subsystem 140, local storage resource 150, and network interface 160 discussed above with respect to FIG. 1. Main housing upper surface 24 couples to main housing portion 12, and may include an integrated keyboard 26 or other I/O devices, such as a mouse or microphone (not shown).

Lid portion 14 is rotationally coupled to main housing portion 12 via hinge assembly 34. Lid portion 14 includes display 28 that visually presents information to the user. Display 28 may be a touch panel with circuitry enabling touch functionality in conjunction with a display. Lid portion 14 may also include timing controller (TCON) 30. Hinge assembly 34 may include cable 36 for communicably coupling one or more components within main portion 12 to one or more components within lid portion 14. For example, cable 36 may provide communication of graphics information from an I/O subsystem to TCON 30 for generation of visual images for display on display 28. Although a single cable 36 is illustrated in FIG. 2, portable information handling system 10 may include one or more additional cables 36 for communicating components disposed in main portion 12 and lid portion 14.

Hinge assembly 34 allows main housing portion 12 and lid housing portion 14 to rotate between a plurality of positions. For example, when portable information handling system 10 is not in use, lid portion 14 may be closed over the top of main portion 12 so that display 28 and keyboard 26 are protected from unintended use or damage. Rotation of lid housing portion 14 by approximately 90 degrees from main housing portion 12 brings display 28 in a raised "clamshell" position relative to keyboard 26 so that an end user can make inputs to keyboard 26 and/or a touch panel portion of display 28 while viewing display 28. In some embodiments, clamshell position may represent lid housing portion 14 open between approximately 1 and 180 degrees from main housing portion 12. Rotation of lid housing portion 14 between approximately 180 and 359 degrees from main housing portion 12 may place portable information handling system 10 in "tablet stand" and/or "tent" positions. In tablet stand and tent positions, the user can make inputs via touch panel portion of display 28 while viewing display 28. A full 360 degree rotation of main portion 12 relative to lid portion 14 provides a tablet configuration having display 28 exposed to accept touch inputs. In any position, user inputs may be communicated to an I/O subsystem and/or processor subsystem of the portable information handling system for processing, and then updated information may be communicated back via cable 36 to display 28 for displaying to the user.

Figure 3A:
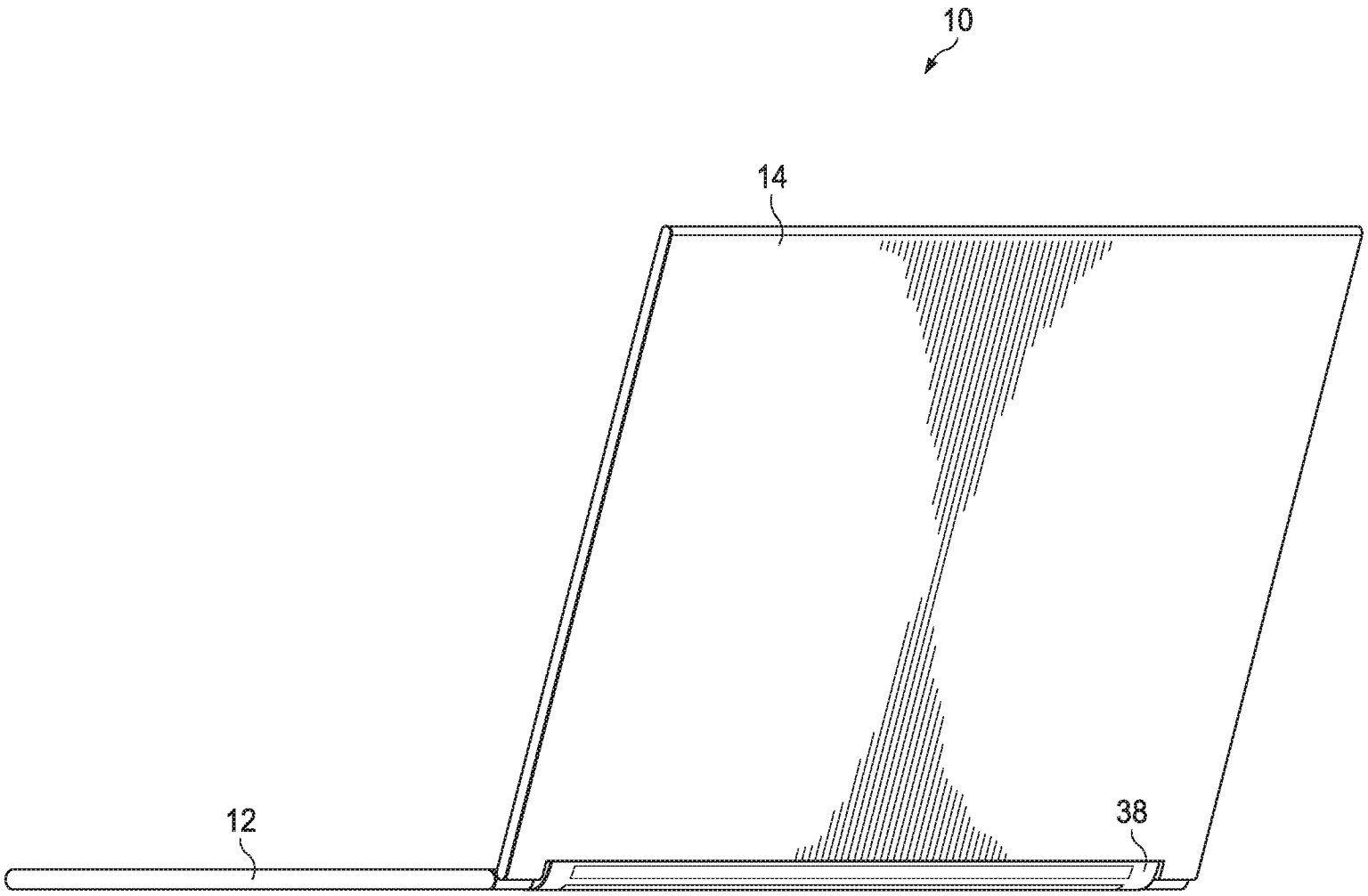
FIG. 3A illustrates a rear perspective view of a portable information handling system in a clamshell open position.

FIG. 3A is a rear perspective view of a portable information handling system 10 in a clamshell open position. Portable information handling system 10 may include elastic cover 38 in a stretched configuration between lid portion 14 and main portion 12. In some embodiments, elastic cover 38 may cover cable 36 and hinge assembly 34. Elastic cover 38 may be comprised of a malleable material, such as an elastic thermoplastic, so that the material may compress and/or stretch as lid portion 14 rotates to different positions relative to main portion 12. For example, elastic cover 38 may stretch to a fully extended configuration as lid portion 14 closes over the top of main portion 12. Elastic over 38 may compress to a fully compressed configuration as lid portion 14 opens to a tablet position (e.g., the rear of lid portion 14 against the bottom of main portion 12). Elastic cover 38 may protect cable 36 and hinge assembly 34 from direct contact by objects external to the portable information handling system.

Figure 3B:
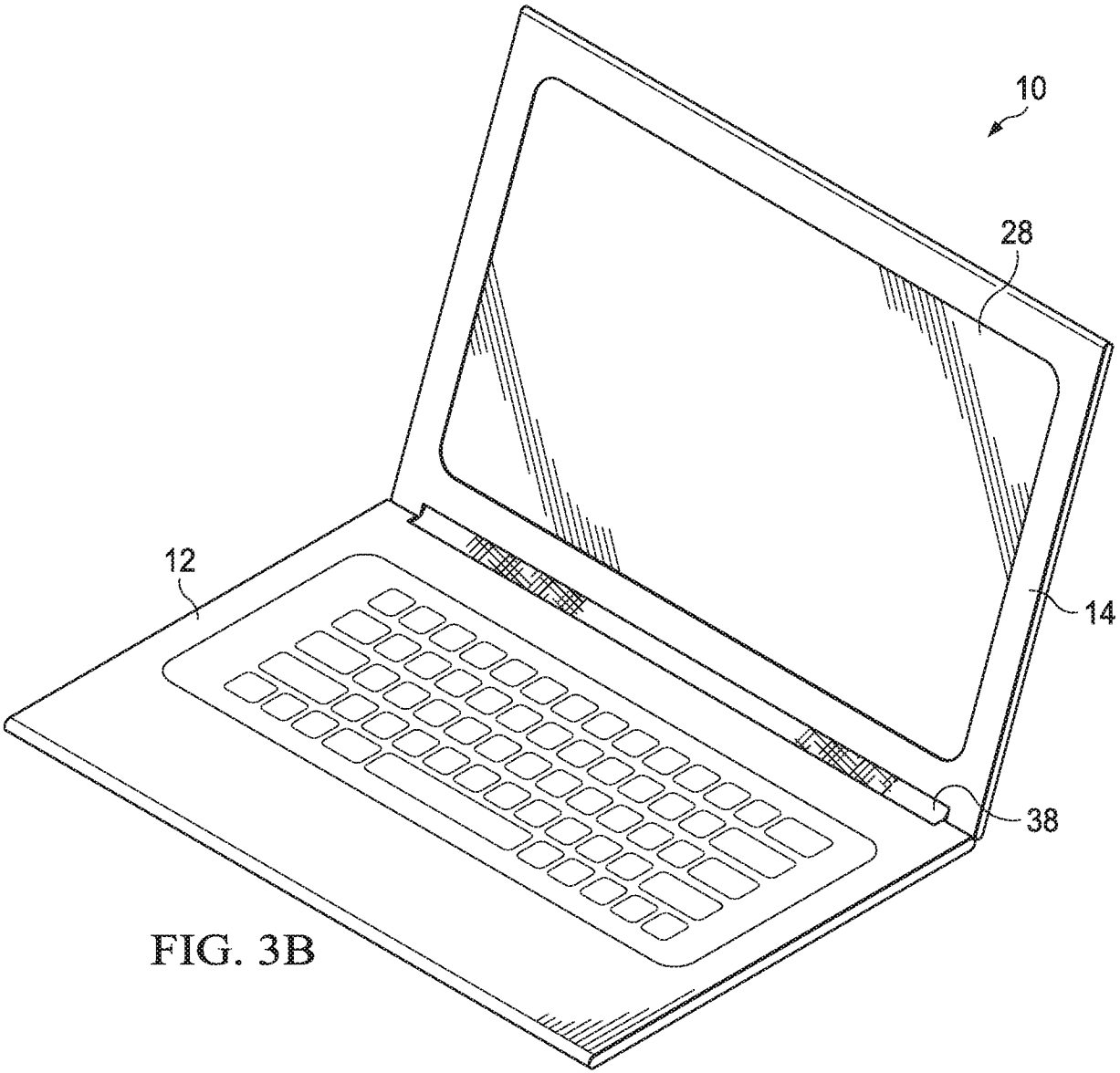
FIG. 3B illustrates a front perspective view of a portable information handling system in a clamshell open position.

FIG. 3B depicts a front perspective view of a portable information handling system in a clamshell open position. Similar to FIG. 3A, elastic cover 38 is in a stretched configuration between lid portion 14 and main portion 12. The relative position for inner elastic cover 38 is approximately 90 degrees as opposed to the 270 degrees of rotation experienced by the outer elastic cover 38 shown in FIG. 3A.

Figure 4:
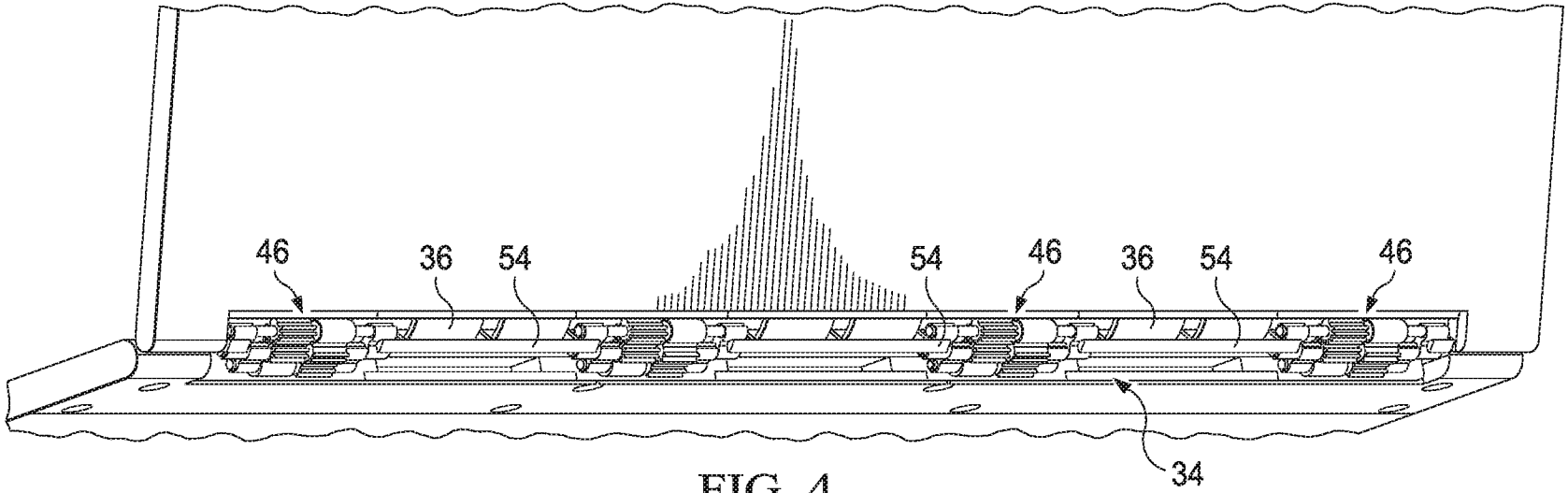
FIG. 4 illustrates a rear side view of a hinge assembly and cables coupled between main and lid housing portions.

Referring now to FIG. 4, a rear side view that depicts hinge assembly 34 and cables 36 coupled between main housing portion 12 and lid housing portion 14. Cable 36 may flex within the space provided between hinges 46 to provide freedom of movement of the housing portions coupled to hinge assembly 34. A hand support 54 is disposed between hinges 46 to restrain elastic cover 38 from interfering with the gear structures of hinge 46 and to provide support against user grasps that press inward against elastic cover 38. In the example embodiment, hinges 46 are evenly displaced across the length of hinge assembly 34 and cables 36 travel between each set of hinges 46. In alternative embodiments, more or fewer hinges 46 may be disposed at irregular distances to make room for cables 36 at particular locations. For example, the center two hinges 46 may have an increased spacing such that more cables 36 may pass through.

Figure 5:
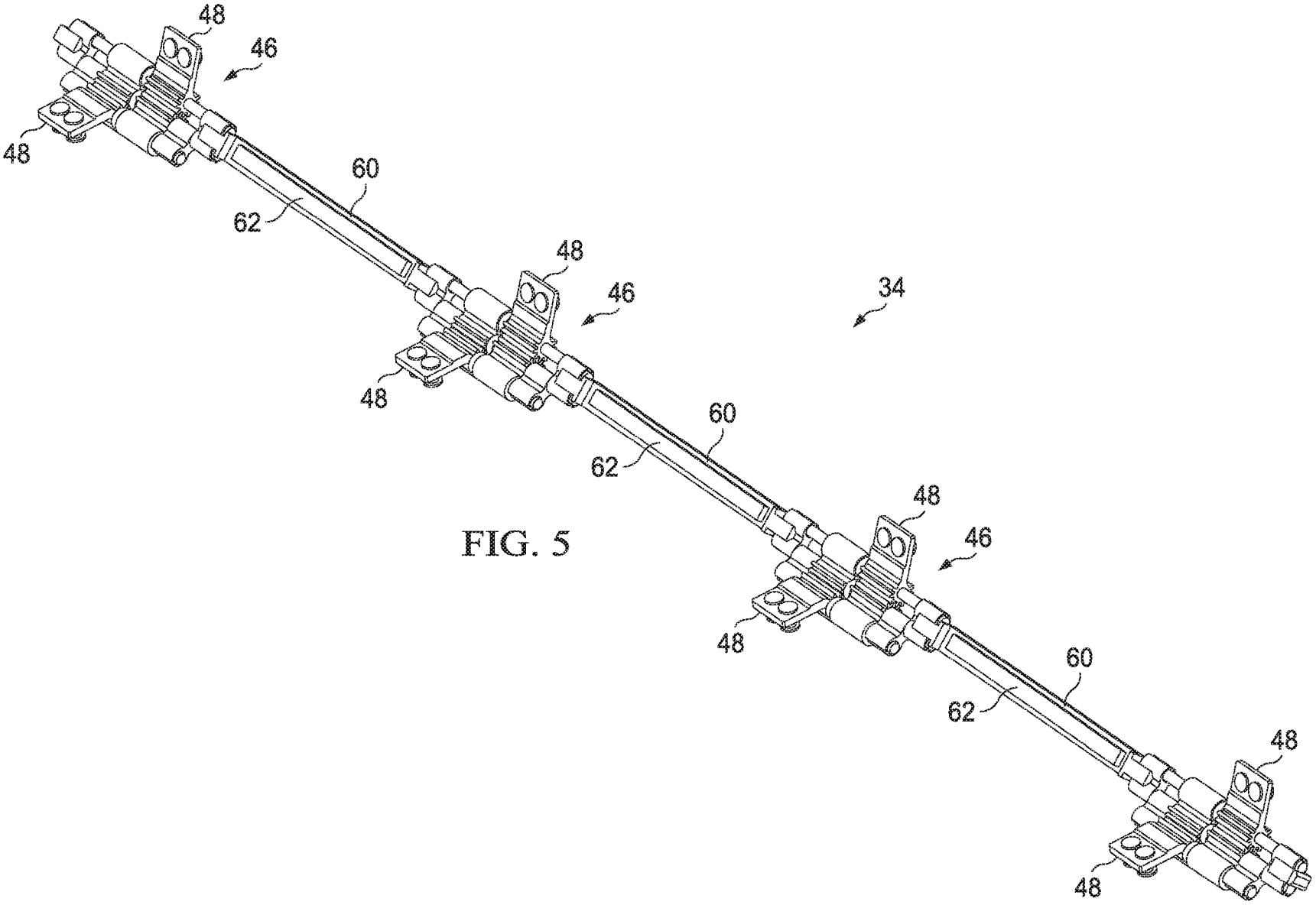
FIG. 5 illustrates an isometric view of a hinge assembly.

FIG. 5 is a front side view of an exemplary hinge assembly with integrated antennas. Antenna frames 60 may be coupled between hinges 46 within hinge assembly 34. As illustrated, antenna frame 60 is a flat rectangular shape comprised of a rigid material, such as plastic or metal, that is coupled to one or more hinges 46. However, antenna frame 60 may be any suitable shape, dimension, or material. One or more antenna 62 may couple to each antenna frame 60. Antenna 62 may be any suitable system, apparatus, or device for receiving and/or transmitting radio signals, including those discussed above with respect to FIG. 1. The number and placement of antenna frames 60 and antennas 62 in the hinge assembly 34 may vary based on wireless needs of the portable information handling system, the type and/or performance of antennas 62, interactions between antennas 62, SAR requirements, size and footprint requirements of the system, and/or other factors. Brackets 48 may couple to hinges 46 such that housing portions and/or other components of hinge assembly 34 may couple to hinges 46.

In a hinge assembly with integrated antennas, the position of antennas 62 may be controlled as a user uses, configures, and/or moves the portable information handling system. For example, the coupling of antenna frame 60 to hinge 46 may be selected to maintain a desired position of antenna 62. As discussed in more detail below with respect to FIGS. 6-8, the position of antenna 62 may be synchronized with the rotation of hinge 46, fixed in an approximately constant position as hinge 46 rotates, and/or rotated in a non-synchronized manner with respect to hinge 46. Antennas 62 within hinge assembly 34 may maintain the same or different positions from each other, and the particular position of each antenna may be selected based on the wireless needs of the portable information handling system, the type and/or performance of antennas 62, interactions between antennas 62, SAR requirements, and/or other factors.

Figure 6A:
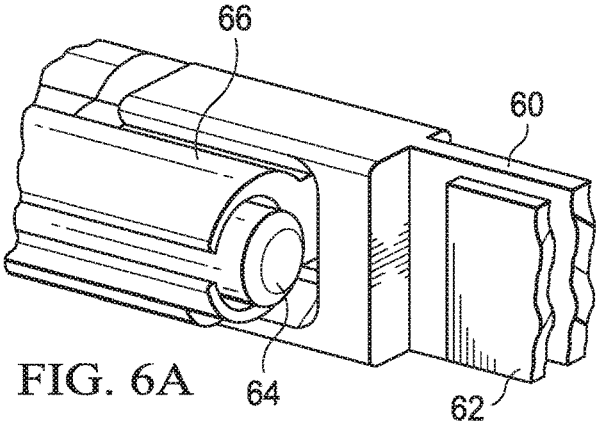
FIGS. 6A-D illustrate a synchronized integrated antenna hinge assembly.

FIGS. 6A-6D illustrates a synchronized rotation integrated antenna hinge assembly. As shown in FIG. 6A, torque element 66 may couple to hinge 46 via pin 64. Pin 64 may couple to gear 68 of hinge 46 such that pin 64 rotates synchronously with the gear. Torque element 66 may also rotate synchronously with gear 68 because of its coupling to pin 64. In turn, antenna frame 60 may couple to torque element 66 such that it rotates synchronously with pin 64. Thus, antenna 62, itself coupled to antenna frame 60, may rotate synchronously with gear 68 of hinge 46.

Figure 6B:
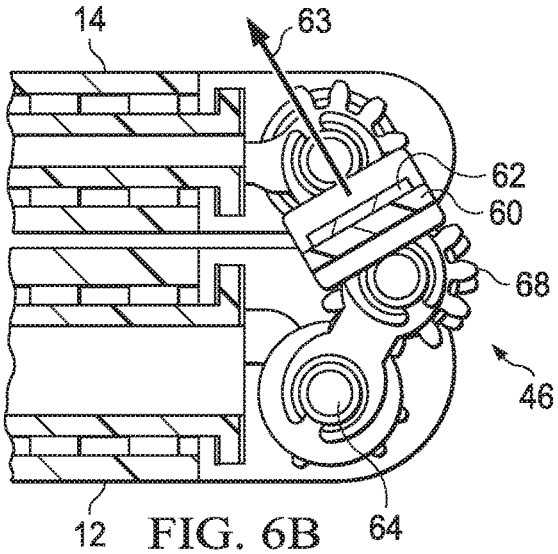
Figure 6C:
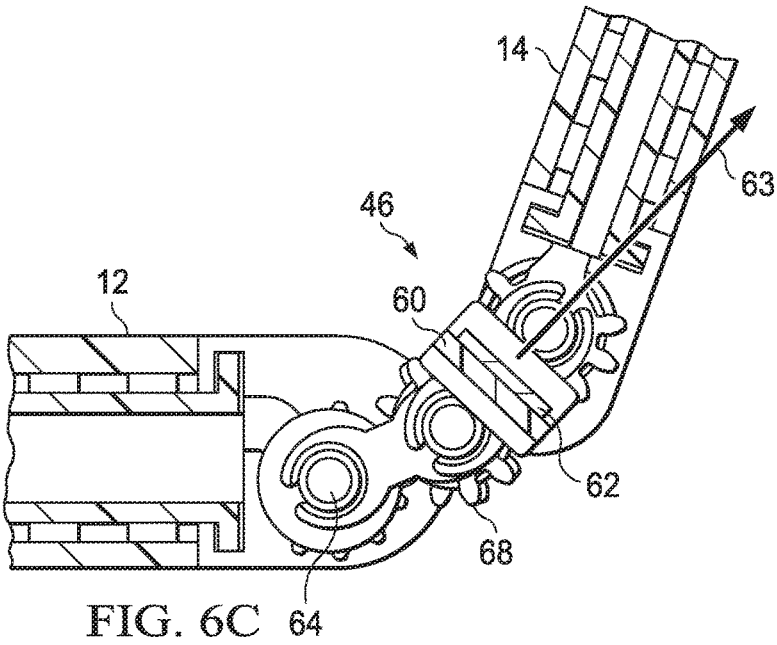
Figure 6D:
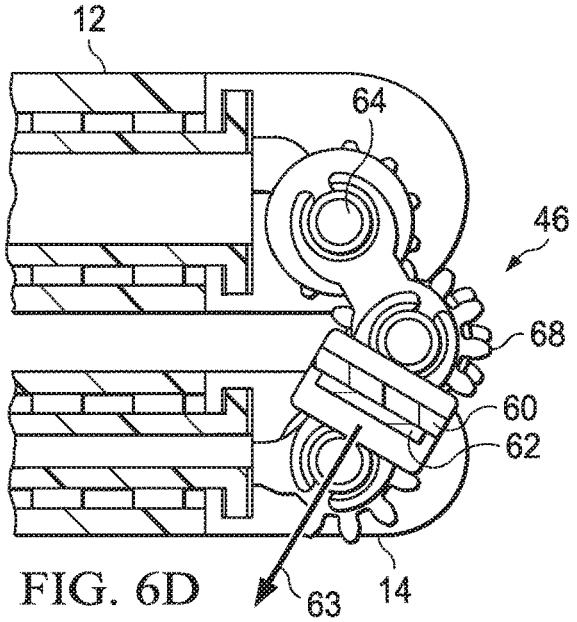

FIGS. 6B-D are cross-sectional views of a synchronized integrated antenna hinge assembly in various positions. For example, FIG. 6B illustrates a cross-sectional view when the portable information handling system is closed (e.g., lid 14 positioned 0 degrees relative to main housing portion 12). The direction of antenna 62 is illustrated by directional arrow 63. FIG. 6C illustrates a cross-sectional view when the portable information handling system is in clamshell position (e.g., lid 14 positioned 110 degrees relative to main housing portion 12). FIG. 6D illustrates a cross-sectional view when the portable information handling system is in tablet position (e.g., FIG. 6D represents lid housing portion positioned 360 degrees relative to main housing portion 12). As can be seen from FIGS. 6B-D, antenna 62 moves synchronously with the gear of hinge 46. That is, the position of antenna 62, represented by directional arrow 63, changes synchronously with the angle of lid 14 relative to main housing portion 12.

Figure 7A:
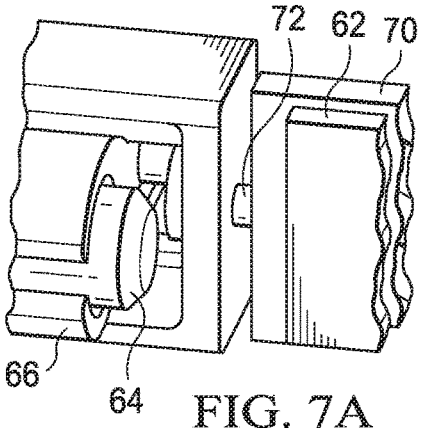
FIGS. 7A-D illustrate a fixed-angle integrated antenna hinge assembly.

FIGS. 7A-7D illustrate a fixed-angle integrated antenna hinge assembly. As shown in FIG. 7A, torque element 66 may couple to hinge 46 via pin 64. Pin 64 may couple to gear 68 of hinge 46 such that pin 64 rotates synchronously with the gear. Torque element 66 may also rotate synchronously with gear 68 because of its coupling to pin 64. Antenna frame 70 may couple to a fixed element (not expressly shown) within torque element 66 via pin 72 such that antenna frame 70 may remain fixed as torque element 66 rotates. As torque element 66 rotates with gear 68, the fixed element within torque element 66 may remain fixed and thus antenna frame 70 may also remain fixed such that the antenna frame maintains a substantially fixed angle with respect to the edge of the information handling system. Thus, antenna 62, itself coupled to antenna frame 70, may maintain a substantially fixed position (e.g., directed away from the edge of the information handling system) even as a user uses, configures, and/or moves the portable information handling system.

Figure 7B:
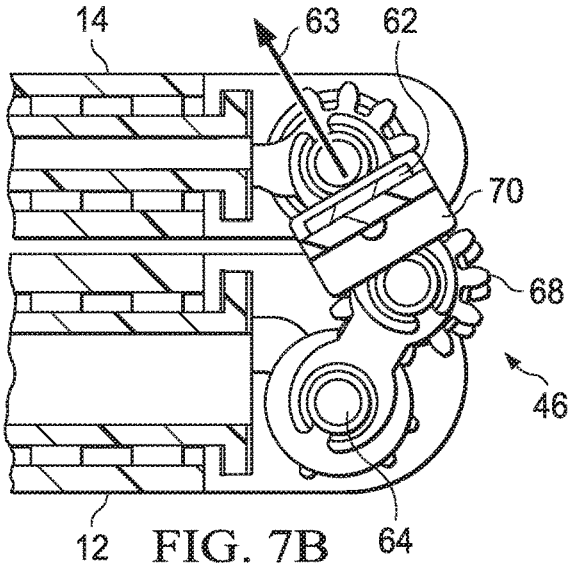
Figure 7C:
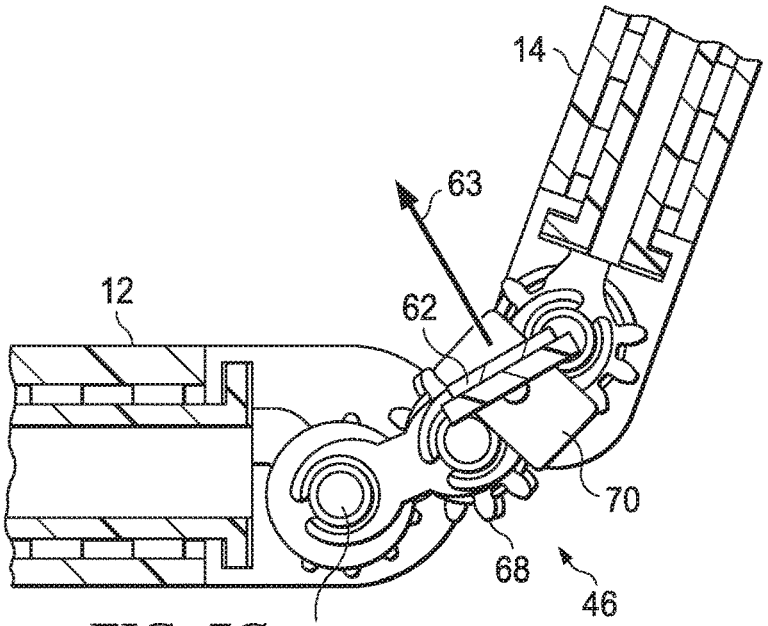
Figure 7D:
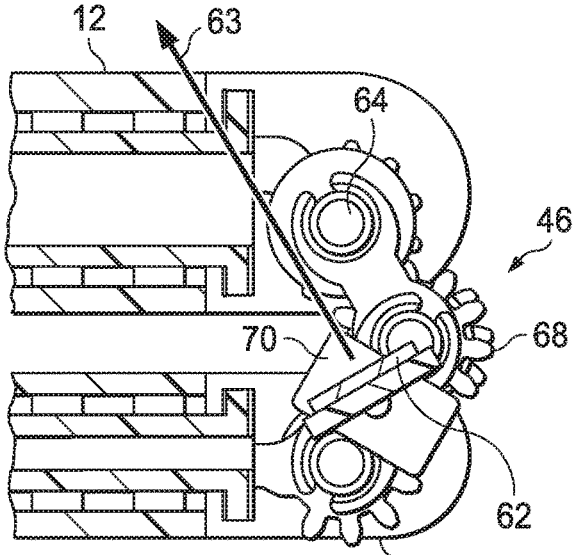

FIGS. 7B-D are cross-sectional views of a fixed integrated antenna hinge assembly in various positions. For example, FIG. 7B illustrates a cross-sectional view when then portable information handling system is closed. The direction of antenna 62 is illustrated by directional arrow 63. FIG. 7C illustrates a cross-sectional view when the portable information handling system is in clamshell position. FIG. 7D illustrates a cross-sectional view when the portable information handling system is in tablet position. As can be seen from FIGS. 7B-D, antenna 62 maintains a substantially fixed position as gear 68 of hinge 46 rotates. The position of antenna 62, represented by directional arrow 63, maintains a substantially fixed direction as the angle of lid 14 relative to main housing portion 12 changes.

Figure 8A:
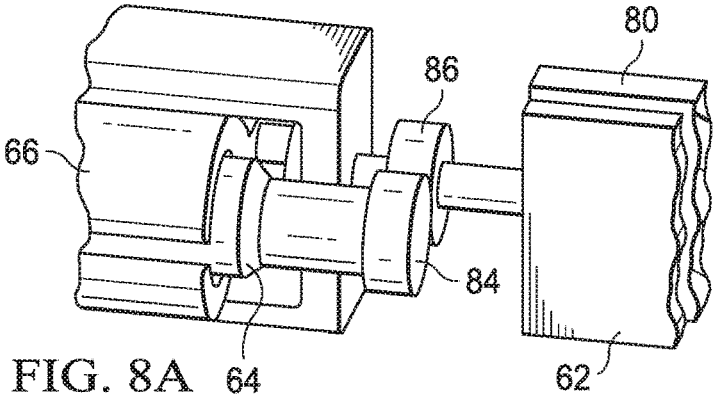
FIGS. 8A-D illustrate a non-synchronized integrated antenna hinge assembly.

FIGS. 8A-8D illustrate a non-synchronized rotation integrated antenna hinge assembly. As shown in FIG. 8A, torque element 66 may couple to hinge 46 via pin 64. Pin 64 may couple to gear 68 of hinge 46 such that pin 64 rotates synchronously with the gear. Torque element 66 may also rotate synchronously with gear 68 because of its coupling to pin 64. Torque element gear 84 may also be attached to pin 64 and/or torque element 66, such that torque element gear 84 rotates synchronously with gear 68 of hinge 46. Antenna frame 80 may be attached to an antenna frame gear 86 and be rotationally coupled to pin 64 via antenna frame gear 86 and torque element gear 84. The size of torque element gear 84 and/or antenna frame gear 86 may determine the position of antenna frame 80 as gear 68 rotates to different positions. For example, the size ratio between torque element gear 84 and antenna frame gear 86 may be selected so that antenna frame 80 rotates in a non-synchronized (e.g., slower, faster, opposite direction, etc.) manner with gear 68 of hinge 46.

Figure 8B:
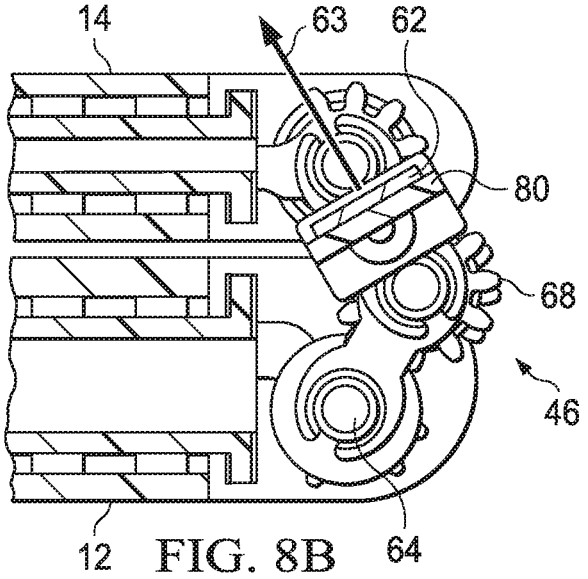
Figure 8C:
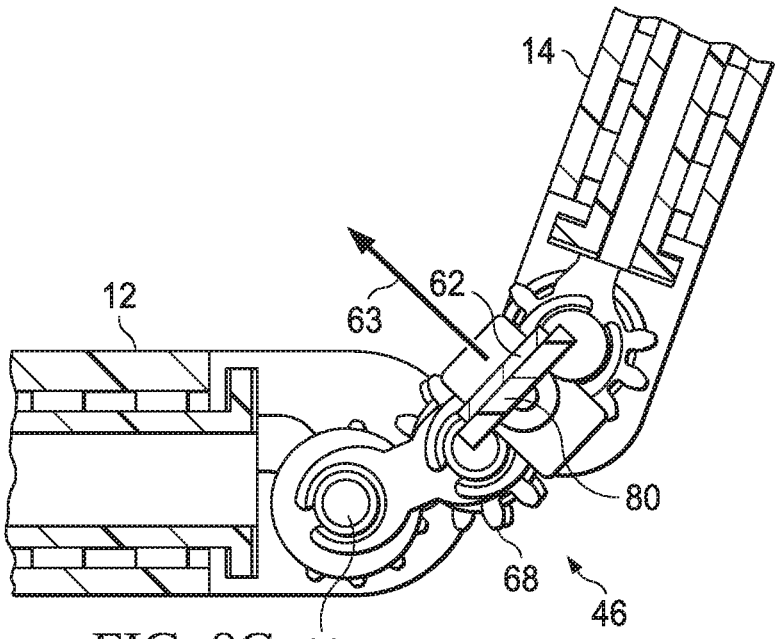
Figure 8D:
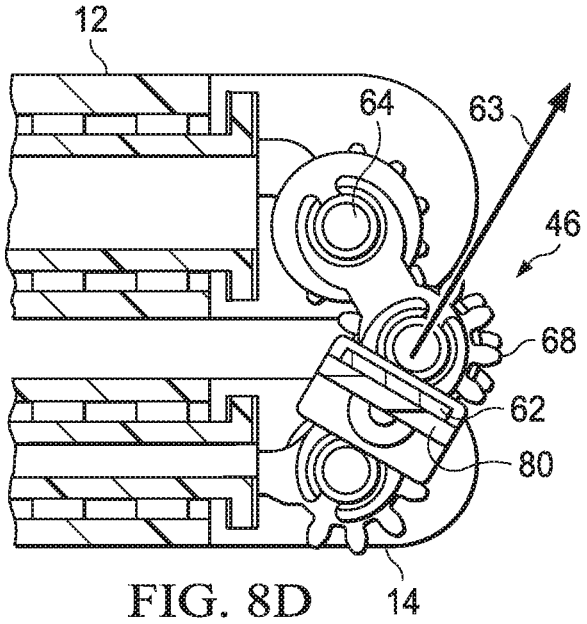

FIGS. 8B-D are cross-sectional views of a non-synchronized integrated antenna hinge assembly in various positions. For example, FIG. 8B illustrates a cross-sectional view when the portable information handling system is closed. The direction of antenna 62 is illustrated by directional arrow 63. FIG. 8C illustrates a cross-sectional view when the portable information handling system is in clamshell position. FIG. 8D illustrates a cross-sectional view when the portable information handling system is in tablet position. As can be seen from FIGS. 8B-D, antenna 62 moves non-synchronously with respect to hinge 46. That is, the position of antenna 62, represented by directional arrow 63, changes non-synchronously with the angle of lid 14 relative to main housing portion 12.

Figure 9:
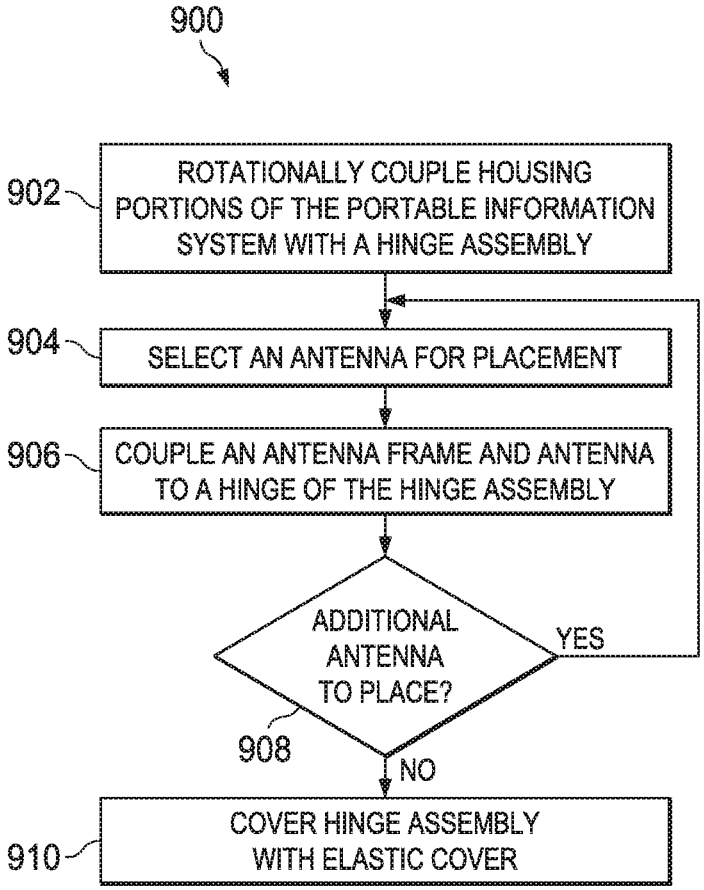
FIG. 9 illustrates a flowchart depicting selected elements of an embodiment of a method for integrating antennas in a hinge shroud in accordance with some embodiments of the present disclosure.

FIG. 9 illustrates an example method 900 incorporating antennas in a hinge assembly of a portable information handling system. Method 900 may begin at step 902, where the housing portions of the portable information handling systems are rotationally coupled by a hinge assembly. The hinge assembly may permit the housing portions to rotate to different positions from each other, including for example, closed, clamshell, tablet stand, tent, and tablet positions discussed above with respect to FIG. 2.

In step 904, method 900 selects an antenna for placement. The portable information handling system may have one or more antennas for wireless communications. The antenna may be any suitable system, apparatus, or device for receiving and/or transmitting radio signals, including those discussed above with respect to FIG. 1.

In step 906, method 900 couples an antenna frame and an antenna to a hinge of the hinge assembly. As shown in FIGS. 6-8, the antenna frame may be coupled to the hinge in different manners such that the position of the antenna is either synchronized with the rotation of a gear of the hinge, fixed in an approximately constant position as the gear rotates, and/or rotated in a non-synchronized manner with respect to the gear. Selection of the particular manner of coupling of the antenna frame to the hinge may be based on the wireless needs of the system, the type and/or performance of antennas, interactions between antennas, SAR requirements, and/or other factors.

In step 908, method 900 may determine whether additional antennas need to be placed. If additional antenna need to be placed in the hinge assembly, then method 900 may proceed back to step 904 such that the remaining antennas are placed. The portable information handling system may use multiple antennas and/or different types of antennas based on the wireless needs of the system, the type and/or performance of antennas, interactions between antennas, SAR requirements, and/or other factors. Placement of subsequent antennas in the hinge assembly (e.g., in step 906) may or may not match that of previously placed antennas. For example, one antenna may be synchronized with the rotation of a gear in the hinge while another may be fixed or non-synchronized. As another example, multiple antennas may be non-synchronized in different manners, such that the antennas move differently (e.g., slower, faster, opposite direction, etc.) user uses, configures, and/or moves the system.

If, however, there are no additional antennas to be placed, then method 900 may proceed to step 910. At step 910, the hinge assembly may be covered by an elastic cover. As discussed above with respect to FIG. 3, the elastic cover may be comprised of a malleable material, such as an elastic thermoplastic, that may compress and/or stretch as the housing portions rotate in different positions to each other. The elastic cover may protect components of the hinge assembly from direct contact by objects external to the portable information handling system. Selection of the material may be based on price, durability, cosmetics, permeability to radio waves, and/or other factors.

Method 900 may be implemented in any suitable manner. It is noted that certain steps or operations described in method 900 may be optional or may be rearranged in different embodiments.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A portable information handling system comprising:

a housing having a first housing portion and a second housing portion;

a hinge assembly coupling the first and second housing portions, the hinge assembly comprising a first gear and a second gear to rotate the first and second housing portions relative to each other;

a first antenna frame coupled to the first gear of a hinge of the hinge assembly, and coupled within the hinge assembly;

a first antenna coupled to the first antenna frame, the first antenna operable to communicate wirelessly with a wireless-enabled device, wherein the first antenna frame is coupled to the first gear such that the first antenna rotates synchronously with the first gear;

a second antenna frame coupled to the second gear of the hinge of the hinge assembly, and coupled within the hinge assembly; and a second antenna coupled to the second antenna frame, the second antenna operable to communicate wirelessly with the wireless-enabled device, wherein the second antenna frame is coupled to the second gear such that the second antenna rotates non-synchronously with the second gear.

2. The system of claim 1, wherein the hinge assembly further comprises a pin coupled to the first gear, wherein the first antenna frame is coupled to the pin such that the first antenna frame rotates synchronously with the pin and the first gear.

3. The system of claim 1, wherein the hinge assembly further comprises:

a pin coupled to the second gear;

a torque element gear coupled to the pin; and an antenna frame gear coupled to the torque element gear, wherein the second antenna frame is coupled to the second antenna frame gear such that the second antenna frame rotates non-synchronously with the second gear.

4. A method of positioning an antenna in a portable information handling system, comprising:

rotationally coupling a first housing portion and a second housing portion of the portable information handling system with a hinge assembly, the hinge assembly comprising a first gear and a second gear to rotate the first and second housing portions relative to each other;

coupling a first antenna frame to the first gear of a hinge of the hinge assembly such that the first antenna frame is coupled within the hinge assembly;

coupling a second antenna frame to the second gear of the hinge of the hinge assembly such that the second antenna frame is coupled within the hinge assembly;

coupling a first antenna to the first antenna frame, the first antenna operable to communicate wirelessly with a wireless-enabled device, wherein the first antenna frame is coupled to the first gear such that the first antenna rotates synchronously with the first gear; and coupling a second antenna to the second antenna frame, the second antenna operable to communicate wirelessly with the wireless-enabled device, wherein the second antenna frame is coupled to the second gear such that the second antenna remains rotates non-synchronously with the second gear.

5. The method of claim 4, wherein the hinge assembly further comprises a pin coupled to the first gear, wherein the first antenna frame is coupled to the pin such that the first antenna frame rotates synchronously with the pin and the first gear.

6. The method of claim 4, wherein the hinge assembly further comprises:

a pin coupled to the second gear;

a torque element gear coupled to the pin; and an antenna frame gear coupled to the torque element gear, wherein the second antenna frame is coupled to the second antenna frame gear such that the second antenna frame rotates non-synchronously with the second gear.

7. A hinge assembly for a portable information handling system, the hinge assembly comprising:

a first gear and a second gear, the first and second gears rotating a first housing portion relative to a second housing portion of the portable information handling system;

a first antenna frame coupled to the first gear;

a second antenna frame coupled to the second gear;

a first antenna coupled to the first antenna frame, the first antenna operable to communicate wirelessly with a wireless-enabled device, wherein the first antenna frame is coupled to the first gear such that the first antenna rotates synchronously with the first gear; and a second antenna coupled to the second antenna frame, the second antenna operable to communicate wirelessly with the wireless-enabled device, wherein the second antenna frame is coupled to the second gear such that the second antenna remains rotates non-synchronously with the second gear.

8. The hinge assembly of claim 7, wherein the first antenna is a different type of antenna than the second antenna.

9. The hinge assembly of claim 7, wherein the first antenna is oriented in a different direction than the second antenna.

* * * * *